US007537418B2

(12) United States Patent
Deal et al.

(10) Patent No.: US 7,537,418 B2
(45) Date of Patent: May 26, 2009

(54) METHODS AND SYSTEMS FOR DELIVERING LOST CIRCULATION MATERIAL INTO DRILLING PITS

(75) Inventors: Benny J. Deal, Perryton, TX (US); Justin Dodd, Perryton, TX (US)

(73) Assignee: Hi-Plains Trading Company, Perryton, TX (US)

( * ) Notice: Subject to any disclaimer, the term of this patent is extended or adjusted under 35 U.S.C. 154(b) by 0 days.

(21) Appl. No.: 11/901,610

(22) Filed: Sep. 17, 2007

(65) Prior Publication Data

US 2008/0069647 A1 Mar. 20, 2008

Related U.S. Application Data

(62) Division of application No. 11/245,508, filed on Oct. 7, 2005, now Pat. No. 7,278,804.

(51) Int. Cl.
*B65G 51/16* (2006.01)

(52) U.S. Cl. ..... 406/12; 406/39; 406/105

(58) Field of Classification Search ..... 406/12, 406/19, 39, 105, 151; 175/206
See application file for complete search history.

(56) References Cited

U.S. PATENT DOCUMENTS

| | | | |
|---|---|---|---|
| 1,340,164 | A | 5/1920 | Golloher |
| 2,721,767 | A | 10/1955 | Kropp |
| 3,171,692 | A | 3/1965 | Beery |
| 3,866,769 | A | 2/1975 | Morey et al. |
| 4,259,764 | A | 4/1981 | Downing |
| 4,431,535 | A | 2/1984 | Spruiell |
| 4,433,946 | A | 2/1984 | Christianson et al. |
| 4,512,405 | A | 4/1985 | Sweatman et al. |
| 4,518,568 | A | 5/1985 | Shannon |
| 4,560,307 | A | 12/1985 | Deitesfeld |
| 4,580,928 | A | 4/1986 | Van Abbema |
| 4,885,012 | A | 12/1989 | Thompson |
| 4,913,597 | A | 4/1990 | Christianson et al. |
| 5,341,856 | A | 8/1994 | Appenzeller |
| 5,669,740 | A | 9/1997 | Townsend et al. |
| 5,669,741 | A | 9/1997 | Ono et al. |
| 5,713,494 | A | 2/1998 | Kaiju et al. |
| 5,725,160 | A | 3/1998 | Harper et al. |

(Continued)

*Primary Examiner*—Douglas A Hess
(74) *Attorney, Agent, or Firm*—Klarquist Sparkman, LLP

(57) ABSTRACT

Disclosed herein are embodiments of an apparatus for delivering lost circulation material, particularly cottonseed hulls, into oil and gas drilling pits. According to one exemplary embodiment, a lost circulation material delivery apparatus for delivering lost circulation material from a bulk source of the material into a drilling well mud pit for controlling lost circulation within an oil or gas drilling well bore can include a bulk source of lost circulation material positioned in the vicinity of but removed from the drilling well mud pit. The apparatus can also include a sorting mechanism in receiving communication with the bulk source where the sorting mechanism includes a lost circulation material metering portion. A lost circulation material conveying portion can be in material receiving communication with the material metering portion at a first end portion and in material expelling communication with the drilling well mud pit at a second end portion. The apparatus can also include a lost circulation material driving source spaced apart from the sorting mechanism and coupled to the conveying portion. In operation, the lost circulation material driving source feeds lost circulation material from the material metering portion, through the conveying portion and into the drilling well mud pit.

10 Claims, 4 Drawing Sheets

U.S. PATENT DOCUMENTS

| | | | | |
|---|---|---|---|---|
| 6,036,407 | A | 3/2000 | Nester | |
| 6,279,471 | B1 | 8/2001 | Reddoch | |
| 6,364,018 | B1 | 4/2002 | Brannon et al. | |
| 6,368,028 | B1 | 4/2002 | Nester | |
| 6,447,215 | B1 | 9/2002 | Wellmar | |
| 6,503,026 | B1 | 1/2003 | Mitchell | |
| 6,530,438 | B1 | 3/2003 | McIntyre | |
| 6,725,930 | B2 | 4/2004 | Boney et al. | |
| 6,749,025 | B1 | 6/2004 | Brannon et al. | |
| 6,772,838 | B2 | 8/2004 | Dawson et al. | |
| 6,910,411 | B2 | 6/2005 | Reddoch | |
| 7,080,960 | B2 | 7/2006 | Burnett | |
| 7,195,084 | B2 * | 3/2007 | Burnett et al. | 175/66 |
| 7,380,618 | B2 * | 6/2008 | Gunderson et al. | 180/8.2 |
| 2002/0147113 | A1 | 10/2002 | Green | |
| 2003/0196805 | A1 | 10/2003 | Boney et al. | |
| 2004/0231849 | A1 | 11/2004 | Cooke, Jr. | |
| 2005/0095070 | A1 | 5/2005 | Wysong | |
| 2005/0106032 | A1 | 5/2005 | McCann | |

* cited by examiner

METHODS AND SYSTEMS FOR DELIVERING LOST CIRCULATION MATERIAL INTO DRILLING PITS

CROSS REFERENCE TO RELATED APPLICATION

This application is a divisional of U.S. patent application Ser. No. 11/245,508, filed Oct. 7, 2005, now U.S. Pat. No. 7,278,804, which is incorporated herein by reference.

FIELD

The present application relates to lost circulation materials and, more particularly, to methods and systems for delivering a quantity of lost circulation materials.

BACKGROUND

Drilling wells to recover oil and gas typically requires introducing a drilling fluid into the well bore and recirculating the drilling fluid up and out of the well bore to lubricate the drilling components, such as the drill string and drill bit, and to maintain the integrity of the well bore during operation of the drill. As the drilling fluid is recirculated up the well bore, the fluid acts as a sealant to keep the walls of the well bore in place, which, among other things, allows the drill pipe to be raised or lowered without obstruction and facilitates removal of drilled material from the well bore.

Lost circulation materials, such as cottonseed hulls, cedar fiber, paper, cottonseed burrs, sawdust, cellophane, calcium carbonate and phenolic plastic, are used as additives in the drilling fluid to fill fissures, porous or fractured formations, or other undesirable subterranean characteristics existing or formed in the side walls of the well bore. Filling the voids in the well bore wall with lost circulation material helps to prevent the recirculating drilling fluid from filling the voids, losing drilling fluid, and ultimately preventing efficient circulation of the fluid and removal of debris from the well, or even complete cessation of the drilling process.

Transporting or delivering lost circulation materials in bulk from a source to the drilling fluid for mixing with the fluid prior to pumping the fluid into the well can be difficult. A known method includes manually unloading large sacks of hulls, e.g., 100-pound sacks, from a transportation vehicle and manually pouring the contents of the sacks into a hopper on top of a mud pit or drilling well for mixing with the drilling fluid. This method, however, can be undesirably inefficient and labor intensive.

In another known method, the lost circulation materials are drawn from a source by a pump, pumped through the pump, discharged out of the pump and through an exhaust, and introduced into the drilling fluid. One known drawback with this method is that the lost circulation materials being pumped through the pump can damage, or otherwise disrupt the performance of, the pump by contacting the pump's moving parts or lodging in portions of the pump resulting in congestion and backup of lost circulation material flow.

Therefore, it would be advantageous to develop methods and systems for delivering lost circulation material, including cottonseed hulls that overcome the drawbacks of known systems.

SUMMARY

Described herein are embodiments directed to a lost circulation material delivery systems and methods capable of moving cottonseed hulls or similar particulate material from a storage source, such as a storage bin or a bulk bag, into a mud pit of an oil or gas drilling well without having to convey the material through a driving device, such as a fan, blower or pump. In some embodiments, the lost circulation material is conveyed into the mud pit through a delivery conduit, such as by air or by an auger-type conveyer.

According to one exemplary embodiment, a method of delivering lost circulation material from a bulk source to a drilling well mud system for controlling lost circulation within the bore includes positioning a bulk container of lost circulation material at a location in the vicinity of but removed from drilling well bore. Lost circulation material is introduced from the bulk container into a sorting mechanism. The method further includes conveying the lost circulation material with a moving device from the sorting mechanism to the drilling well mud system along a path separated from the moving device.

In some implementations the path can include a conduit. In specific implementations, the method can further include creating pneumatic pressure within the conduit to create a stream of pressurized air directed toward the drilling well mud system and feeding the lost circulation material from the sorting mechanism into the stream of pressurized air.

In some implementations, the path is free of mechanical obstructions.

In certain implementations, the bulk container can include a bulk bag and introducing lost circulation material can include gravitationally feeding the material from the bag into the sorting mechanism.

In other implementations, a conduit can be in receiving communication with the bulk container of lost circulation material and expelling communication with the sorting mechanism. Further, in some implementations, introducing lost circulation material from the bulk container into the sorting mechanism can include creating a negative air pressure within the conduit to draw lost circulation material through the conduit.

According to another exemplary embodiment, a method of delivering cottonseed hulls from a bulk source to a drilling well mud system a for controlling lost circulation within the bore can include positioning a bulk container of cottonseed hulls at a location in the vicinity of but removed from the drilling well mud system. The method can further include providing a passageway extending from a source of pneumatic pressure to the drilling well bore and creating pneumatic pressure within the passageway to create a stream of pressurized air from the source of pneumatic pressure to the drilling well bore. The cottonseed hulls can be fed into the stream of pressurized air within the conduit downstream of the source of pressurized air to intermix the hulls with the air. The method can also include conveying the hulls through the passageway to the drilling well mud system.

In some implementations, the cottonseed hulls can be fed into the air stream at a substantially constant rate of delivery. In other implementations, the cottonseed hulls may be fed into the stream by gravity. In yet other implementations, conveying the hulls comprises subjecting the hulls to negative air pressure from the source into the stream. In some implementations, the stream can be free of mechanical obstructions where the cottonseed hulls enter the conduit and downstream therefrom.

According to another embodiment, a lost circulation material delivery apparatus for delivering lost circulation material from a bulk source of the material into a drilling well mud pit for controlling lost circulation within an oil or gas drilling well bore can include a bulk source of lost circulation material positioned in the vicinity of but removed from the drilling well mud pit. The apparatus can also include a sorting mechanism in receiving communication with the bulk source where the sorting mechanism includes a lost circulation material metering portion. A lost circulation material conveying portion can be in material receiving communication with the material metering portion at a first end portion and in material expelling communication with the drilling well mud pit at a second end portion. The apparatus can also include a lost circulation material driving source spaced apart from the sorting mechanism and coupled to the conveying portion. In operation, the lost circulation material driving source feeds lost circulation material from the material metering portion, through the conveying portion and into the drilling well mud pit.

In some implementations, the lost circulation material driving source of the apparatus includes at least one electrically powered blower. In certain implementations, the at least one blower generates an air flow within the conveyor to carry the lost circulation material from the sorting mechanism, through the conveying portion and into the drilling well mud pit. In other implementations, the apparatus includes a conduit in receiving communication with the bulk source of lost circulation material at a first end and coupled to a cylindrical housing mounted to the sorting mechanism at a second end opposite the first end. The apparatus can include a conduit coupled to an input of the blower at a first end and the cylindrical housing at a second end opposite the first end. Activation of the blower creates a negative air pressure to draw in lost circulation material from the bulk source.

In specific implementations, the bulk source can include a bag suspendable above the sorting mechanism and have an opening. Gravity can be used to cause lost circulation material in the bag to pass through the opening and into the sorting mechanism.

In some implementations, the lost circulation material driving source can be a hydraulically or an electrically powered auger-type mechanism.

In some implementations, the sorting mechanism can further comprise a separator portion having multiple projecting fin-like elements and positioned above the lost circulation material metering portion.

In other implementations, the apparatus can include an air moving path and a material moving path and wherein the material moving path does not include the driving source.

In yet other implementations, the lost circulation material driving source can operate at a substantially constant rate, and wherein the material metering portion is selectively controllable to operate at variable rates.

The foregoing and other features and advantages of the application will become more apparent from the following detailed description, which proceeds with reference to the accompanying figures.

DETAILED DESCRIPTION

Embodiments of a lost circulation material delivery system for delivering lost circulation material, preferably cottonseed hulls, from a source to a drilling well site are described herein. The drilling well site can include an oil or gas drilling well bore in communication with a mud system, such as a mud pit, configured to prepare and convey drilling fluid or drilling mud into the drilling well bore. The lost circulation material delivery system delivers lost circulation material and introduces it to the mud system to be mixed with the drilling fluid prior to the fluid entering the pit. The various embodiments of the delivery system are configured such that the lost circulation material need not be drawn into and passed through a pump, fan or other material moving device with moving parts along its path to be delivered to the mud system.

Figure 1:
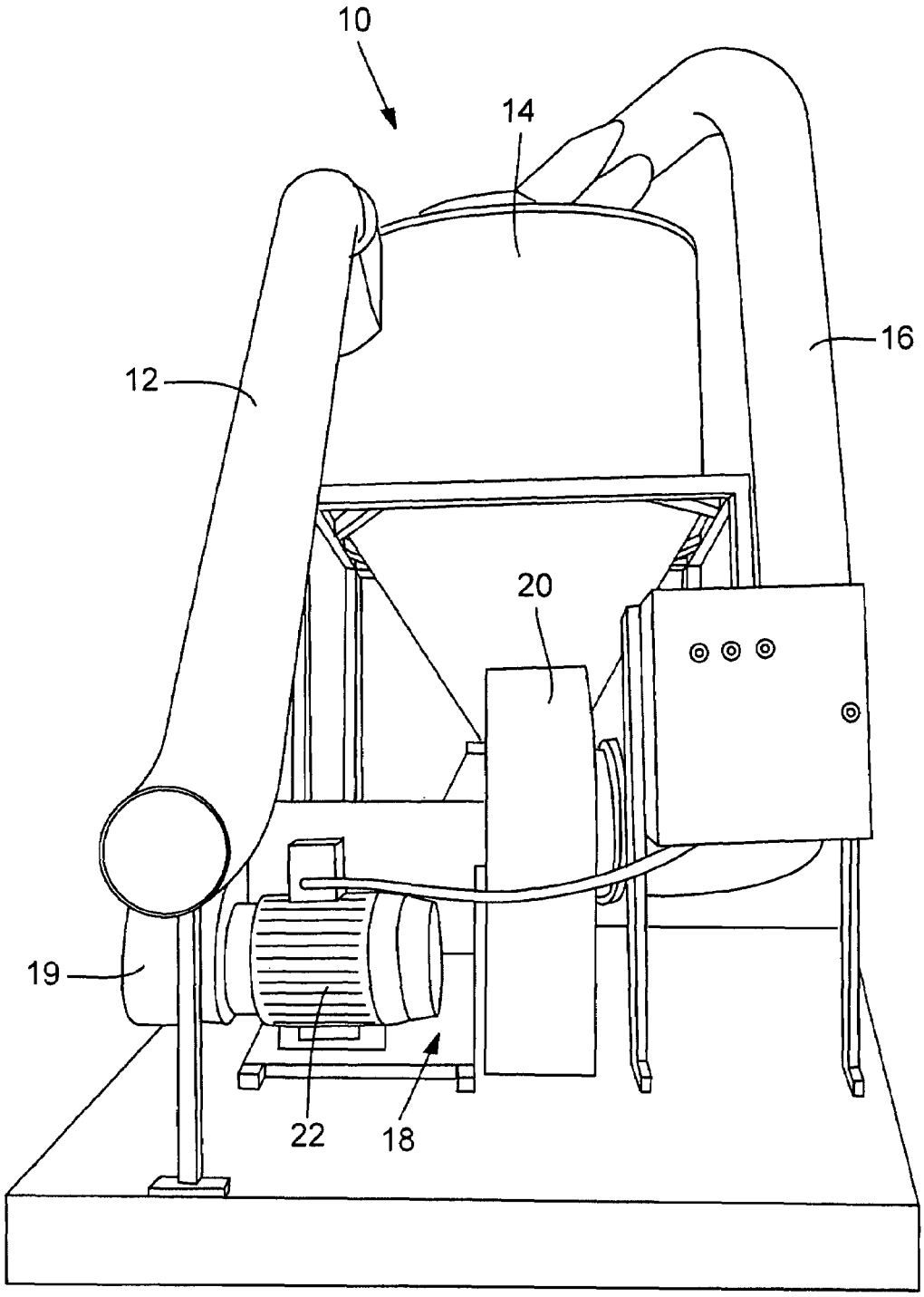
FIG. 1 is a perspective front view of an exemplary embodiment of a lost circulation material delivery system.
Figure 3:
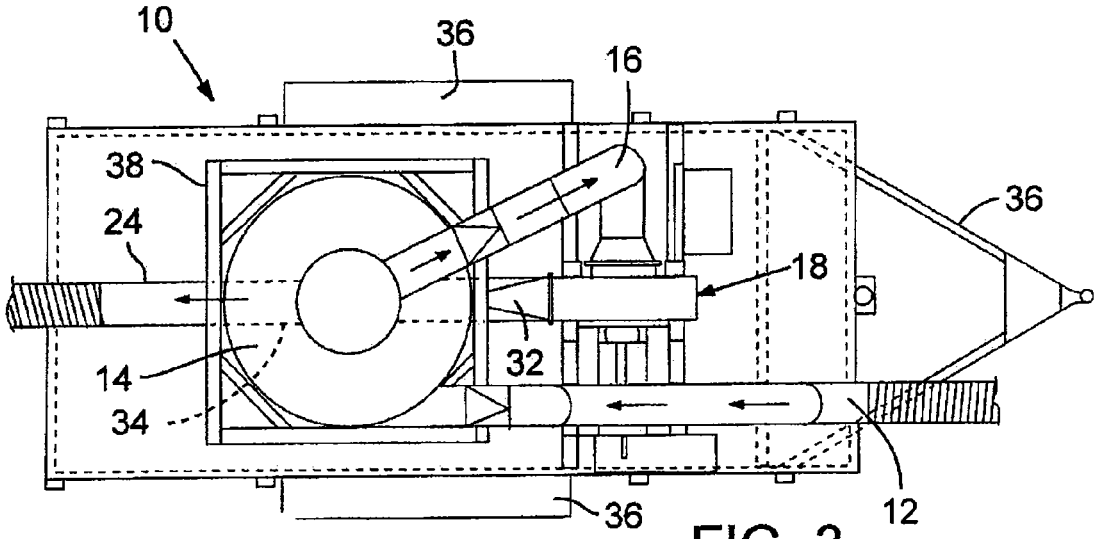
FIG. 3 is a top plan view of the delivery system of FIG. 2.
Figure 2:
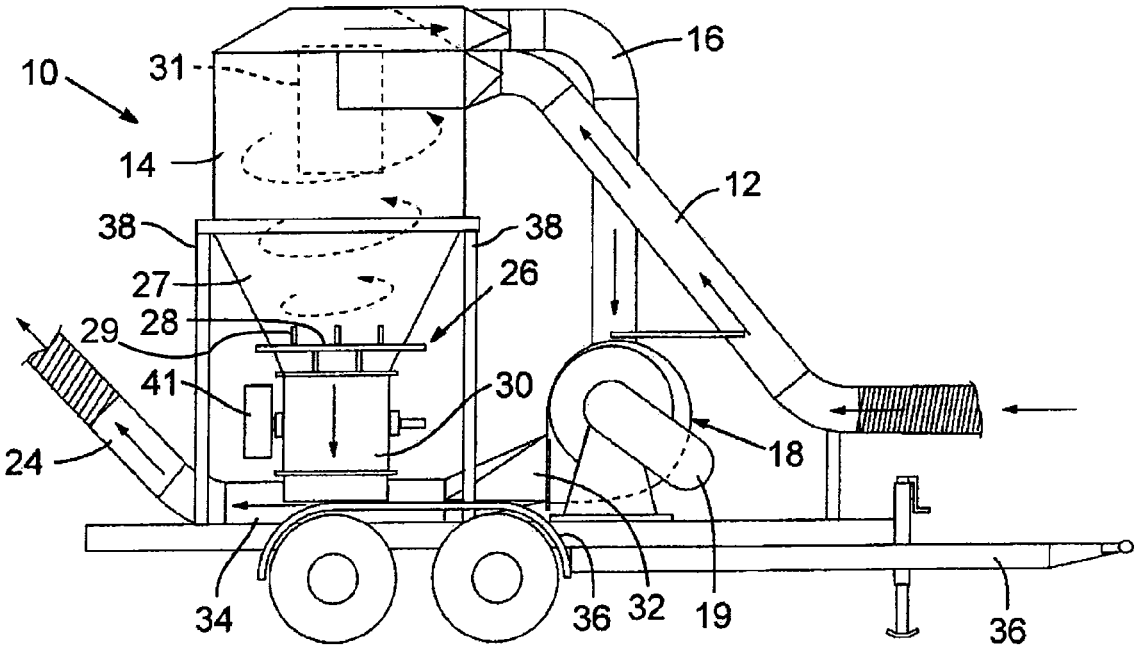
FIG. 2 is an elevational left side view of the delivery system of FIG. 1.

According to one exemplary embodiment, a lost circulation material delivery system is indicated generally at 10 in FIGS. 1-3.

Referring to FIGS. 1-3, the delivery system 10 includes a lost circulation material retrieval passageway, such as hose or pipe 12, with an inlet end 12*a* positioned in contact with or near a source 13, such as, e.g., a van trailer with a supply of lost circulation material, and an opposite outlet end 12*b* coupled generally tangential to an upper portion of a cylindrical hollow cyclone housing 14. The housing 14 can be mounted to and at least partially supported by a box frame 38 made of multiple reinforcing tubular members supported in turn by a base frame such as the frame of trailer 36. In some implementations, the hose 12 can include a rigid fixed pipe section and a flexible tube section coupled to the pipe section. An air drawing hose or pipe 16 is coupled to an uppermost portion of the cyclone housing 14, such that it is in air receiving communication with the central channel 31 at one end, and a material moving device, e.g., a fan portion 20 of a pump mechanism 18, at an opposite end.

The fan can be driven by a driving device, such as a 20-horsepower electrical motor 22, that is coupled to the fan via a belt housed in belt cover 19 and engaged with a shaft of the driving device and the fan. Although a 20-horsepower electrical motor is shown, it is recognized that other motors having varying power outputs can be used.

As shown in FIGS. 2 and 3, the system 10 also includes a sorting portion 26 coupled to a bottom end of the cyclone housing 14 and in hull receiving communication with the housing. The sorting portion 26 includes a funnel, or hopper, portion 27 attached to the cyclone housing 14 at an upper end and a vacuum dropper 30 at a lower end. The funnel portion 27 can have a frustoconical shape or any shape where the upper end of the funnel portion has a larger cross-section than the lower end of the funnel portion.

A separator 28 is positioned within the funnel portion 27 intermediate the upper and lower ends. In some implementations, the separator 28 includes a stationary horizontally oriented grate-like plate having multiple openings with projecting spaced-apart partitions or fins 29 positioned adjacent the openings. In other implementations, the separator 28 can be movable.

The vacuum dropper 30 is coupled to a generally elongate rectangular blow box 34 at a lower end and has an opening at its lower end that opens into a material receiving opening in the blow box. The vacuum dropper 30 includes a horizontal rotatable shaft within a housing that is selectively rotated by an electric motor mechanism 41, such as a motor and gear assembly, coupled to the shaft. The shaft has a series of paddles or fins extending the length of the shaft. The fins can be spaced apart at approximately equal distances from each other.

The blow box 34 is positioned downstream of the pump mechanism 18 and is separated from the pump mechanism by an enclosed passageway or conduit 32. The blow box 34 has an inlet end coupled to the enclosed passageway or conduit 32 and an outlet end coupled to a lost circulation material delivery passageway, such as hose or pipe 24. The hose 24 extends from the blow box 34 to a drilling well mud system, or mud pit, 25 that can be located proximate the drilling well. In some implementations, the hose 24 can include a rigid pipe section coupled to a flexible tube section.

In some implementations, the system 10 can be removably mounted to a transportation vehicle, such as trailer 36 to be transported to an oil or gas drilling well site. In some exemplary implementations, the system can be between approximately 8 and 12 feet high and the pipes or hoses 12, 16, 24 can have an approximate internal diameter between about 8 and 14 inches. In a specific implementation, the system 10 is approximately ten feet high and the pipes or hoses 12, 16, 24 have an approximate internal diameter of about 10 inches.

In operation, the electrical motor 22 is selectively operated to drive, or rotate, a fan housed within the fan portion 20. When rotated, the blades of the fan are oriented to remove air located approximately within the generally cylindrical volume with a cross-section indicated by dashed-line 31 in FIG. 2 from the cyclone housing 14 through pipe 16 to create a vacuum, i.e., negative pressure, which acts to draw in air from the lost circulation material source via hose 12. The air drawn through the hose 12 urges lost circulation material, such as cottonseed hulls, to be drawn through the hose 12 with the air. The cottonseed hull and air mixture flows through the hose as indicated in FIGS. 2 and 3 until it enters the cyclone housing where the cottonseed hulls are separated from the air as they flow cyclically and downwardly as indicated into the funnel portion 27 until they contact the separator 28.

Because of the cyclonic effect of the lost circulation material upon entering the housing 14, the air within the volume 31, which is approximately coaxial with the housing, is substantially void of lost circulation material. Accordingly, the pump mechanism 18, receives the air from the housing 14 via pipe 16 does not receive or interact with lost circulation materials.

The separator 28 receives the cottonseed hulls, the separator fins separate, or break up, hulls that may be clumped together in masses, and the hulls fall through the multiple openings into the vacuum dropper 30. Hulls falling through the separator 28 collect in the spaces defined between adjacent fins as the vacuum dropper shaft rotates. Additional rotation causes the hulls collected in each space to fall into the blow box 34 as the shaft rotates to expose the respective spaces to the material receiving opening in the blow box. The rate of rotation of the shaft can be selectively and variably controlled by operation of the motor mechanism 41 to meter the flow or amount of cottonseed hulls allowed to pass into the blow box 34. In some implementations, the dropper 30 has between 6 and 8 fins and the shaft can be controlled to rotate between about 5 and 60 rpm. In certain implementations, the fins are made of a resilient rubber or elastomeric material.

Air drawn from the cyclone housing 14 passes through the pump 18 and is expelled or blown into the blow box 34 via hose 32. The air flowing through the blow box 34 carries the hulls entering the blow box from the dropper 30 into the hose 24 at a relatively constant rate. The hulls are then transported through the hose 24 to the drilling well mud system to be introduced into the drilling fluid.

Figure 4:
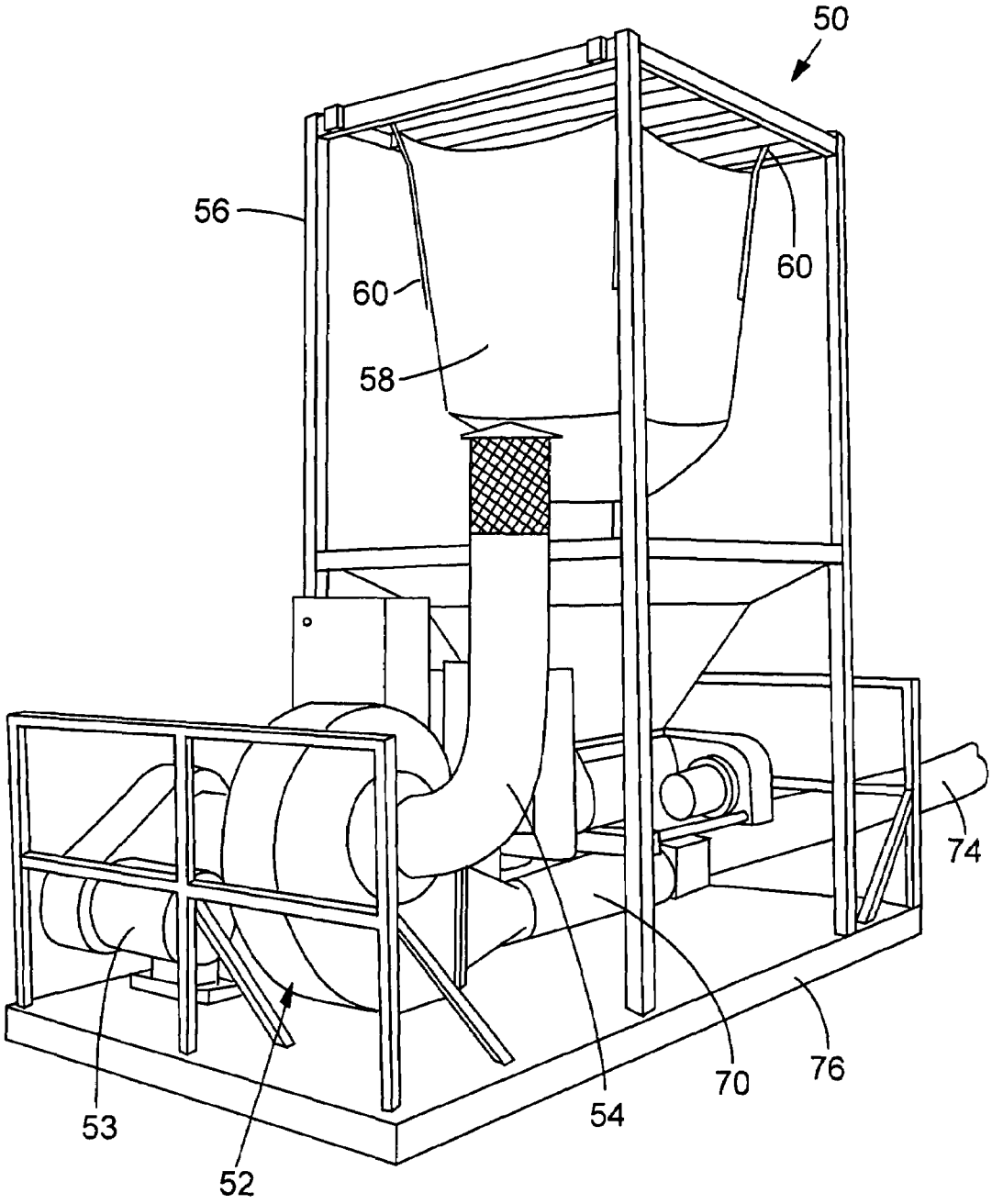
FIG. 4 is a perspective view of another embodiment of a lost circulation material delivery system using circulation material containing bulk bags.
Figure 5:
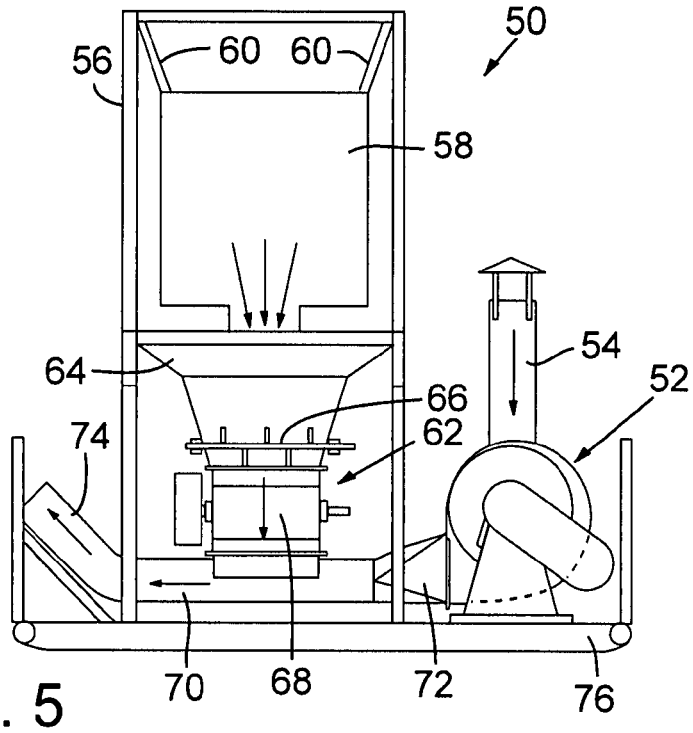
FIG. 5 is an elevational side view of the delivery system of FIG. 4.

Referring now to FIGS. 4 and 5, another embodiment of a lost circulation material delivery system is indicated generally at 50 and includes a pump 52 with a fan that is selectively driven by a driving device, such as a 10-horsepower electrical motor 53, to deliver lost circulation material, such as cottonseed hulls, from a source other than a van trailer or truck, such as bulk bag 58, to a drilling well mud system or mud pit (not shown). Although a 10-horsepower electrical motor is shown, it is recognized that other motors having varying power outputs can be used.

The bulk bag 58 contains cotton seed hulls and can be suspended from a rigid box frame 56 directly over a sorting portion 62 by a suspension element, such as suspension straps 60, which can be made from an interwoven fabric mesh, a chain, a spring, or other suitable coupling element or elements. In some implementations, the bulk bag 58 can contain between approximately 1,500 and 2,000 or more pounds of lost circulation material with multiple bulk bags being transportable to and storable at the drilling site.

The sorting portion 62 can include a surge hopper 64 at an upper first end and a blow box 70 at a lower end. A vacuum dropper 68, with features similar to vacuum dropper 30 of FIGS. 2-3, is positioned intermediate the surge hopper 64 and the blow box 70 and a separator 66, similar to separator 28 of FIGS. 2-3, can be positioned within the hopper.

The pump 52 includes an inlet coupled to an air intake passageway 54 and an outlet coupled to a connecting passageway 72, which couples the pump outlet with an inlet end of the blow box 70. A lost circulation material delivery passageway, such as hose 74, can be connected to an outlet end of the blow box 70 at a first end with a second end opposite the first end positioned in ejecting communication with a drilling well mud pit.

The system 50 can be mounted to a transportable platform 76, which can be easily transported by a trailer or truck to the drilling well site. In specific implementations, the system 50 can be between approximately 10 and 13 feet high, the frame 56 can be between approximately 4 and 6 feet wide and the pipe 74 can have between an 8- and 10-inch internal diameter. Also, a distance between the horizontal shafts of the separator 66 and the vacuum dropper 68 can be between approximately 1 and 3 feet.

In operation, a forklift, or other lifting device, lifts a bulk bag 58 containing cottonseed hulls and the suspension elements, each with one end initially secured to either the frame 56 or an upper portion of the bag 58 and the other end coupled to the bag or frame, respectively, suspend the bag from the frame. A sealed pre-formed opening in a lower portion of the bulk bag 58 is unsealed, for example, by untying a knotted rope, and gravity urges the cottonseed hulls to fall into the surge hopper 64. The separator breaks up hull masses that may have formed and the flow of hulls into the blow box are metered by the vacuum dropper 68.

The electric motor is activated to drive the fan, which draws in ambient air via the air intake tube 54. The air is then expelled or blown out of the pump 52 and into the hose 72 before passing into and through the blow box 70. The air flowing through the blow box 70 carries the hulls entering the blow box from the dropper 68 into the hose 74. The hulls are then transported through the hose 64 to the drilling well site at a relatively constant rate to be introduced into the mud pit.

Figure 6:
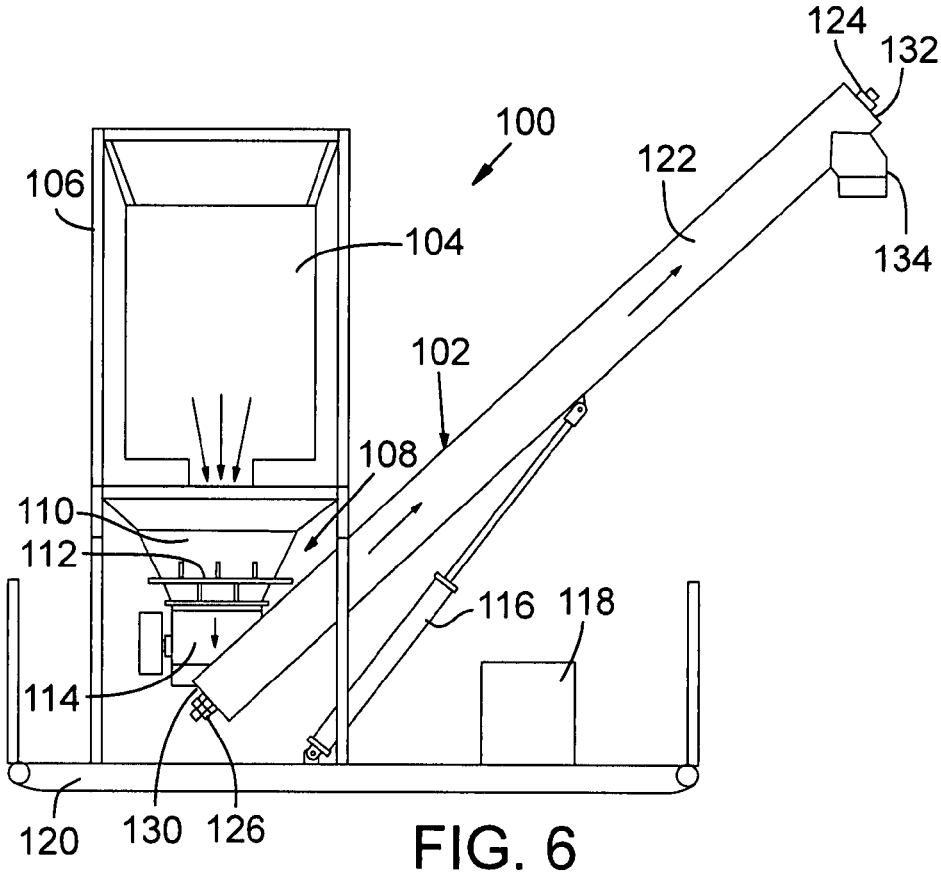
FIG. 6 is an elevational side view of another embodiment of a lost circulation material delivery system using an auger mechanism.

Referring now to FIG. 6, another embodiment of a lost circulation material delivery system is indicated generally at 100 and includes an auger-type conveyor portion 102. Similar to the delivery system 50 of FIGS. 4 and 5, the delivery system 100 includes a bulk bag 104 containing cottonseed hulls attached to a rigid box frame 106 and suspended over a sorting portion 108. The sorting portion 108 includes a surge hopper 110, separator 112 and a vacuum dropper 68 configured to receive hulls from the bulk bag 104 and introduce them into the auger-type conveyor portion 102 in a manner similar to that described above for introducing hulls into the blow boxes 34, 70 of FIGS. 1-5.

The conveyor portion 102 includes a channel, such as pipe 122, housing a rotating auger 124 and being pivotable about an inlet end 130. A drive motor 126 is coupled to the auger 124 proximate the inlet end 130 of the pipe 122 to rotatably drive the auger. The pipe 122 is attached to an actuator, such as hydraulic actuator 166, which is selectively driven by a hydraulic power unit 118 to raise or lower an outlet end 132 of pipe 122 opposite the inlet end 130.

In a specific implementation, the pipe 122 can have an approximate internal diameter of approximately 10 inches and the frame 106 can be approximately 12 feet high and 5.5 feet wide. The position of the actuator 116 and the length of the pipe 122 can be predetermined to produce a desired vertical and horizontal position of the conveyor portion pipe outlet end 132. For example, the outlet end 132 can be positioned at approximately 14 feet above the ground.

In operation, the cottonseed hulls from the bulk bag 104 pass through the sorting portion 108 in a manner similar to that described above as relating to the sorting portion 62 shown FIGS. 4-5, except that instead of being introduced into a blow box, the hulls are introduced into the conveyor portion 102. The drive motor 126 rotates the auger 124 such that the auger blades continually shift or convey the hulls upward along the pipe 122 at a relatively constant rate until the hulls are expunged through an opening 134 in the pipe proximate its outlet end 132 and fall, or are otherwise introduced, into a drilling well mud system or pit (not shown).

The system 100 can be mounted to a transportable platform 120 that can be moved to a location proximate the drilling well or mud pit. The actuator 116 can be selectively extended and retracted to raise and lower, respectively, and move rearwardly and forwardly, respectively, the outlet end of the pipe 122 such that the hulls exiting the opening in the outlet end fall into the drilling well mud system.

In several implementations, many of the rigid components of the illustrated embodiments, such as the cyclone housing, frames, rigid sections of the pipes and sorting portion components, can be made from steel, while the flexible components, such as the flexible sections of the pipes, can be made from an elastomeric or plastic material.

Although one preferred lost circulation material is cottonseed hulls, other lost circulation materials, such as cedar fiber, paper, cottonseed burrs, sawdust, cellophane, calcium carbonate, phenolic plastic or other material that can be used as an additive in the drilling fluid to fill fissures, porous or fractured formations, or other undesirable subterranean characteristics existing or formed in the side walls of the well bore, can also be used in the described systems and methods.

In view of the many possible embodiments to which the principles of the disclosed invention may be applied, it should be recognized that the illustrated embodiments are only preferred examples of the invention and should not be taken as limiting the scope of the invention. Rather, the scope of the invention is defined by the following claims. We therefore claim as our invention all that comes within the scope and spirit of these claims.

We claim:

1. A lost circulation material delivery apparatus for delivering lost circulation material from a bulk source of the material into a drilling well mud pit for controlling lost circulation within a gas or oil drilling well bore, comprising:

a bulk source of lost circulation material positioned in the vicinity of but removed from the drilling well mud pit;

a sorting mechanism in receiving communication with the bulk source;

a lost circulation material conveying portion in material receiving communication with the sorting mechanism at a first end portion and in material receiving communication with the drilling well mud pit at a second end portion; and a lost circulation material driving source spaced apart from the sorting mechanism and coupled to the conveying portion;

wherein the lost circulation material driving source feeds lost circulation material from the sorting mechanism, through the conveying portion and into the drilling well mud pit.

2. The lost circulation material delivery apparatus of claim 1, wherein the lost circulation material driving source comprises at least one electrically powered blower.

3. The lost circulation material delivery apparatus of claim 2, wherein the at least one blower generates an air flow within the conveying portion to carry the lost circulation material from the sorting mechanism, though the conveying portion and into the drilling well mud pit.

4. The lost circulation material delivery apparatus of claim 2, wherein the bulk source comprises a bag suspendable above the sorting mechanism and having an opening, wherein gravity causes lost circulation material in the bag to pass though the opening and into the sorting mechanism.

5. The lost circulation material delivery apparatus of claim 1, wherein the lost circulation material driving source comprises a hydraulically or an electrically powered auger-type mechanism.

6. The lost circulation material delivery apparatus of claim 1, wherein the sorting mechanism comprises a separator portion having multiple projecting fin-like elements and positioned above the lost circulation material metering portion.

7. The lost circulation material delivery apparatus of claim 1, further comprising an air moving path and a material moving path and wherein the material moving path does not include the driving source.

8. The lost circulation material delivery apparatus of claim 1, wherein the sorting mechanism comprises a lost circulation material metering portion, wherein the lost circulation material driving source operates at a substantially constant rate, and wherein the material metering portion is selectively controllable to operate at variable rates.

9. The lost circulation material delivery apparatus of claim 1, wherein the sorting mechanism comprises a lost circulation material metering portion.

10. A lost circulation material delivery apparatus for delivering lost circulation material from a bulk source of the material into a drilling well mud pit for controlling lost circulation within a gas or oil drilling well bore, comprising:

a bulk source of lost circulation material positioned in the vicinity of but removed from the drilling well mud pit;

a sorting mechanism in receiving communication with the bulk source;

a lost circulation material conveying portion in material receiving communication with the sorting mechanism at a first end portion and in material expelling communication with the drilling well mud pit at a second end portion;

a lost circulation material driving source comprising at least one electrically powered blower which is spaced apart from the sorting mechanism and coupled to the conveying portion;

a conduit in receiving communication with the bulk source of lost circulation material at a first end and coupled to a cylindrical housing mounted to the sorting mechanism at a second end opposite the first end; and a conduit coupled to an input of the blower at a first end and to the cylindrical housing at a second end opposite the first end;

wherein activation of the blower creates a negative air pressure to draw in lost circulation material from the bulk source; and wherein the lost circulation material driving source feeds lost circulation material from the sorting mechanism, through the conveying portion and into the drilling well mud pit.

* * * * *

UNITED STATES PATENT AND TRADEMARK OFFICE

CERTIFICATE OF CORRECTION

PATENT NO. : 7,537,418 B2
APPLICATION NO. : 11/901610
DATED : May 26, 2009
INVENTOR(S) : Deal et al.

It is certified that error appears in the above-identified patent and that said Letters Patent is hereby corrected as shown below:

In the specification,

Column 7,
Line 58, "receiving" should be --expelling--.

Column 8,
Line 7, "though" should be --through--.

Signed and Sealed this
First Day of December, 2015

Michelle K. Lee

Michelle K. Lee
*Director of the United States Patent and Trademark Office*